US008943627B2

(12) United States Patent
Wilkinson

(10) Patent No.: US 8,943,627 B2
(45) Date of Patent: Feb. 3, 2015

(54) CUSHIONING DEVICE AND METHOD OF CUSHIONING A BODY

(71) Applicant: Jeffrey W. Wilkinson, Bennington, VT (US)

(72) Inventor: Jeffrey W. Wilkinson, Bennington, VT (US)

( * ) Notice: Subject to any disclaimer, the term of this patent is extended or adjusted under 35 U.S.C. 154(b) by 24 days.

(21) Appl. No.: 13/655,799

(22) Filed: Oct. 19, 2012

(65) Prior Publication Data

US 2014/0109319 A1 Apr. 24, 2014

(51) Int. Cl.
*A47C 27/08* (2006.01)
*A61G 7/057* (2006.01)

(52) U.S. Cl.
CPC ..... *A47C 27/083* (2013.01); *A47C 27/082* (2013.01); *A61G 7/05723* (2013.01)
USPC ..... 5/710; 5/652.1; 5/690; 5/706; 5/707; 5/709; 5/713

(58) Field of Classification Search
CPC ..... A61G 7/05776; A61G 7/05769; A61G 7/1021; A61G 2203/34; A47C 27/10; A47C 27/18; A47C 27/081; A47C 27/082; A47C 27/084; A47C 27/083; A47C 27/088
USPC ..... 5/652.1, 690, 706, 707, 709, 710, 713, 5/714, 716, 724
See application file for complete search history.

(56) References Cited

U.S. PATENT DOCUMENTS 4,679,264 A 7/1987 Mollura
4,797,962 A * 1/1989 Goode ..... 5/713
4,993,920 A * 2/1991 Harkleroad et al. ..... 417/44.2
5,020,176 A * 6/1991 Dotson ..... 5/710
5,103,519 A * 4/1992 Hasty ..... 5/715
5,129,115 A * 7/1992 Higgins et al. ..... 5/713
5,138,729 A * 8/1992 Ferrand ..... 5/713
5,584,085 A * 12/1996 Banko ..... 5/710
5,634,224 A * 6/1997 Gates ..... 5/709
5,649,331 A 7/1997 Wilkinson et al.
5,652,985 A 8/1997 Wilkinson et al.
5,797,155 A * 8/1998 Maier et al. ..... 5/654
6,014,784 A * 1/2000 Taylor et al. ..... 5/713
6,036,271 A 3/2000 Wilkinson et al.
6,209,159 B1 4/2001 Murphy
6,269,505 B1 * 8/2001 Wilkinson ..... 5/713
6,370,716 B1 * 4/2002 Wilkinson ..... 5/715
6,564,411 B2 * 5/2003 Pirzada ..... 5/713
6,813,790 B2 * 11/2004 Flick et al. ..... 5/713
6,826,795 B2 12/2004 Wilkinson
7,240,386 B1 * 7/2007 McKay et al. ..... 5/724
7,886,386 B2 * 2/2011 Balonick et al. ..... 5/709
8,122,545 B2 * 2/2012 Wilkinson ..... 5/713
8,261,387 B2 9/2012 Lipman et al.
8,397,326 B2 * 3/2013 Lafleche et al. ..... 5/713
2008/0028534 A1 2/2008 Wilkinson
2010/0146709 A1 6/2010 Lafleche et al.

* cited by examiner

*Primary Examiner* — William Kelleher
*Assistant Examiner* — David R Hare
(74) *Attorney, Agent, or Firm* — Schmeiser, Olsen & Watts, LLP

(57) ABSTRACT

Disclosed herein is a cushioning device that includes a plurality of fluid cells each containing a reforming element and a fluid for supporting a load. The cushioning device further includes a manifold system interconnecting the plurality of fluid cells and an exhaust system including a first and a second exhaust reservoir connected in series to the plurality of envelopes. The cushioning device further includes a pressure relief valve and a check valve separating the first and second exhaust reservoirs. Further disclosed is a method of cushioning a body with a cushioning device.

25 Claims, 6 Drawing Sheets

P1<P2<P3

CUSHIONING DEVICE AND METHOD OF CUSHIONING A BODY

FIELD OF TECHNOLOGY

The subject matter disclosed herein relates generally to a cushioning device and method of cushioning a body or a patient. More particularly, the subject matter relates to a cushioning device having a dynamic exhaust reservoir system and method of cushioning a body or a patient using a dynamic exhaust reservoir system.

BACKGROUND

In the medical field, cushioning devices including a plurality of fluid cells are often used to provide support for a body or a patient. These systems typically intake fluid from the atmosphere and exhaust fluid into the atmosphere in order to achieve dynamic pressurization within the plurality of air cells. This intake and exhaust of atmospheric air may thus provide for a dynamic cushioning system that maintains and changes pressures with a manifold system and valve systems that are integrated into the system. A potential need exists in the medical community for closed systems that have no contact with atmospheric air during typical use. A closed system such as this has the capabilities of reducing contamination which can be safer for the patient's health. However, a dynamic system that provides for dynamic pressure changes in the cushioning device has not been optimized in a closed system.

Thus, a cushioning device having a dynamic exhaust reservoir system and a method of cushioning a patient using a dynamic exhaust reservoir system would be well received in the art.

SUMMARY

According to a first described aspect, a cushioning device comprises: a plurality of fluid cells each containing a reforming element and a fluid for supporting a load; a manifold interconnecting the plurality of fluid cells; an exhaust system including a first and a second exhaust reservoir connected in series to the plurality of envelopes; and a pressure relief valve and a check valve separating the first and second exhaust reservoirs.

According to a second described aspect, a cushioning device comprises: a plurality of fluid cells, each of the fluid cells including a reforming element; a manifold system interconnecting the plurality of fluid cells; a first exhaust reservoir connected to the plurality of fluid cells with a first pressure relief valve and a first check valve; and a second exhaust reservoir connected to the first exhaust reservoir with a second pressure relief valve and a second check valve; wherein when the pressure in the plurality of fluid in the plurality of fluid cells reaches a first predetermined level, the first pressure relief valve opens and exhausts fluid into the first exhaust reservoir, and wherein when the pressure in the first exhaust reservoir reaches a second predetermined level, the second pressure relief valve opens and exhausts fluid into the second exhaust reservoir.

According to a third described aspect, a method of cushioning a patient comprises: providing a cushion including a plurality of fluid cells each containing a reforming element and a fluid for supporting a load, a manifold system interconnecting the plurality of fluid cells and an exhaust system including a first exhaust reservoir and a second exhaust reservoir connected in series to the plurality of envelopes; exhausting fluid from the plurality of fluid cells to the first exhaust reservoir when pressure in the plurality of fluid cells reaches a first predetermined pressure; exhausting fluid from the first exhaust reservoir to the second exhaust reservoir when pressure in the first exhaust reservoir reaches a second predetermined pressure; and returning fluid from the first exhaust reservoir and the second exhaust reservoir to the plurality of fluid cells when a load is removed from the plurality of fluid cells.

BRIEF DESCRIPTION OF THE DRAWINGS

The subject matter disclosed herein is distinctly claimed in the claims at the conclusion of the specification. The foregoing and other features and advantages are apparent from the following detailed description taken in conjunction with the accompanying drawings in which:

DETAILED DESCRIPTION

A detailed description of the hereinafter described embodiments of the disclosed apparatus and method are presented herein by way of exemplification and not limitation with reference to the Figures.

Figure 1:
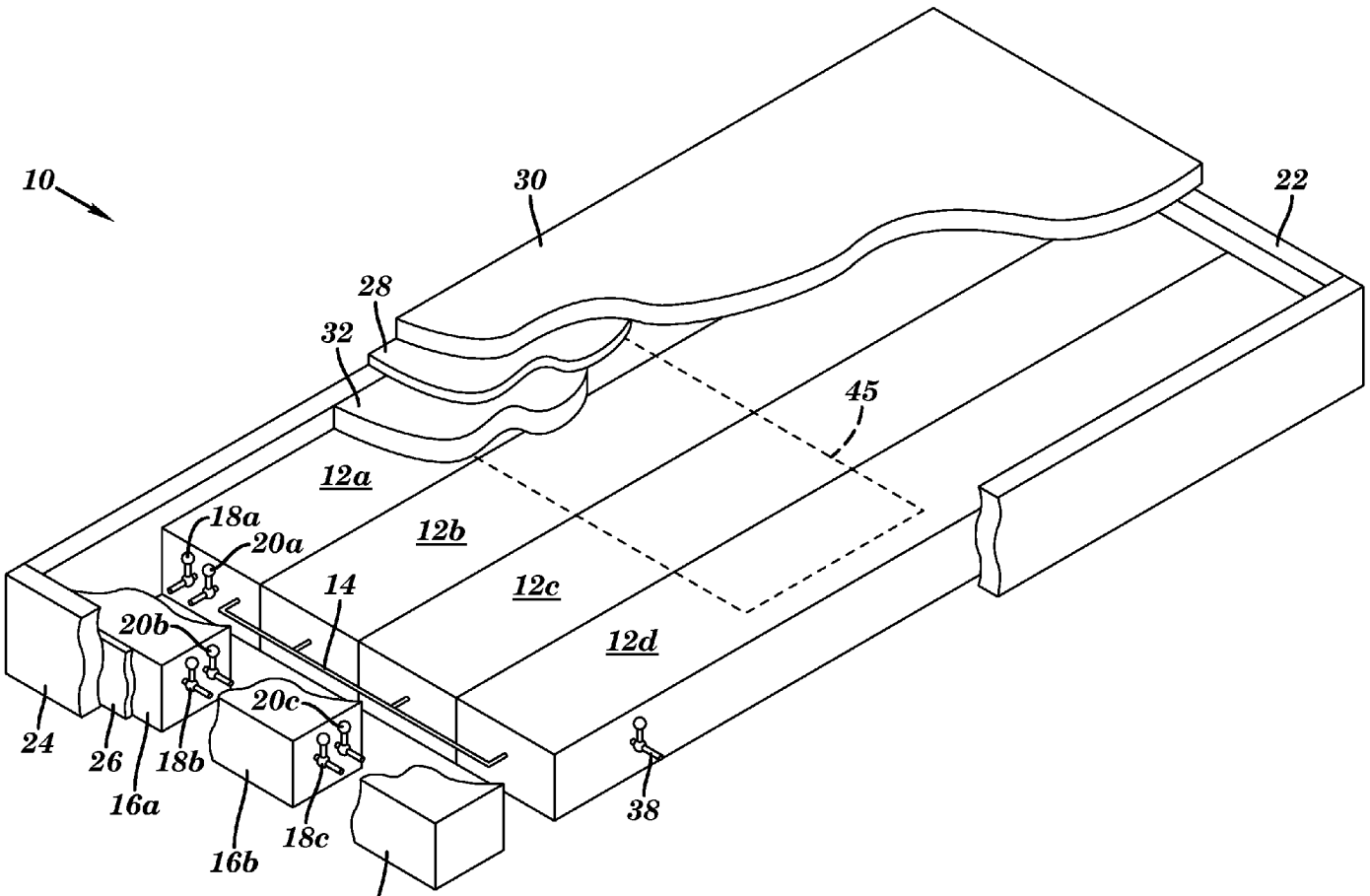
FIG. 1 depicts a perspective cutaway view of a cushioning device according to one embodiment.
Figure 2:
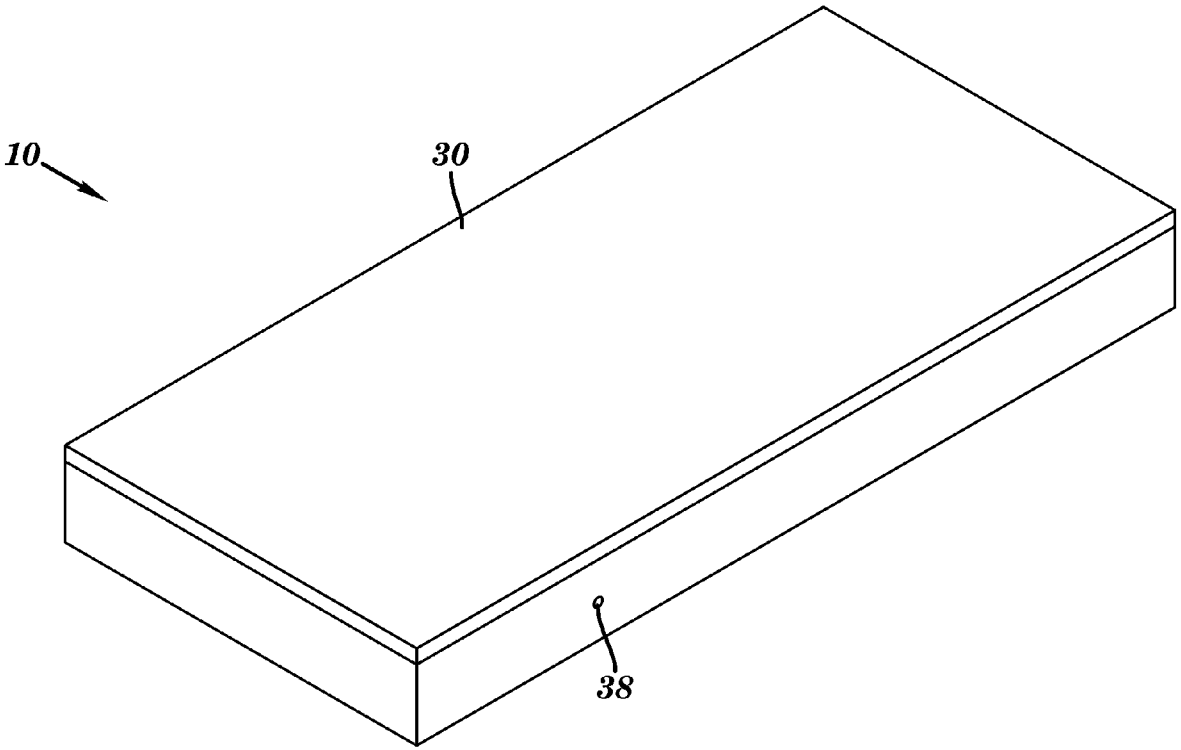
FIG. 2 depicts a perspective view of the cushioning device of FIG. 1 according to one embodiment.

FIGS. 1-2 show a cushioning device 10 that includes a plurality of fluid cells 12. The cushioning device 10 further includes a manifold system 14 interconnecting the plurality of fluid cells 12. A first exhaust reservoir 16*a* is connected to the plurality of fluid cells 12 with a first pressure relief valve 18*a* and a first check valve 20*a*. A second exhaust reservoir 16*b* is connected to the first exhaust reservoir 16*a* with a second pressure relief valve 18*b* and a second check valve 20*b*. Furthermore, a third exhaust reservoir 16*c* is shown connected to the second exhaust reservoir 16*b* with a third pressure relief valve 18*c* and a third check valve 20*c*. When the pressure in the plurality of fluid cells 12 reaches a first predetermined level, the first pressure relief valve 18*a* may be configured to open and exhaust fluid into the first exhaust reservoir 16*a*. Likewise, when the pressure of the first exhaust reservoir reaches a second predetermined level which may be higher than the first predetermined level, the second pressure relief valve 18*b* may be configured to open and exhaust fluid into the second exhaust reservoir 16*b*. Similarly, when the pressure of the second exhaust reservoir reaches a third predetermined level which may be higher than the first and second predetermined levels, the third pressure relief valve 18*c* may be configured to open and exhaust fluid into the third exhaust reservoir 16*c*. The increases in pressure in the plurality of fluid cells 12 and the exhaust reservoirs 16*a*-16*c* may be a result of a patient's weight or load. Fluid may be returned from the exhaust reservoirs 16*a*-16*c* by the check valves 20*a*-20*c* when a load is removed from the plurality of cells 12. Thus, the cushioning device 10 may be a dynamic system that changes in pressure due to loading as desired. However, the cushioning device 10 may also be a closed system in that it does not access atmospheric air during typical use of the cushioning device 10. This may help to prevent contamination and retain sterility of the cushioning device 10. Furthermore, the fact that the cushioning device 10 is a closed system, the combined volume of each of the plurality of fluid cells 12 and each of the exhaust reservoirs 16 is small enough that fluid always remains between the entirety of area contacted by the load or patient and a bottom surface of the cushioning device 10. In other words, the cushioning device 10 will never bottom out on a patient because of a reduced amount of air in the system.

As shown in FIGS. 1-2, the cushioning device 10 may be a mattress in one embodiment. However, it should be understood that this embodiment is not limiting. In other embodiments, the cushioning device 10 may be a chair, couch, loveseat, cushion, or any other cushioning device. Furthermore, a structural bed (not shown) may be manufactured to include an integrated mattress in accordance with the principles of the present disclosure. The disclosure accounts for possible implementations in any type of cushioning device.

The cushioning device 10 is shown having four fluid cells 12*a*, 12*b*, 12*c* and 12*d*. However, in other embodiments more or less fluid cells may be used. These fluid cells 12 each extend between a head end 22 to a foot end 24 of the cushioning device 10. In other embodiments, the fluid cells 12 may extend horizontally across the cushioning device 10 instead of vertically from the head end to the foot end. In one embodiment, a single large fluid cell may be used without the need for a manifold.

The first, second and third exhaust reservoirs 16*a*, 16*b*, 16*c* are located proximate the foot end 24 of the cushioning device 10 between the plurality of fluid cells 12 and the foot end 24. The first, second and third exhaust reservoirs 16*a*, 16*b*, 16*c* are shown cutaway in FIG. 1 to reveal the valves 18, 20. However, it should be understood that these reservoirs may be substantially a cube, a rectangular prism or rounded at the corners and tubular in shape. In one embodiment, the reservoirs may be spherical. Any appropriate shape may be used. A foam pad 26 may retain the exhaust reservoirs 16*a*, 16*b*, 16*c* in position and retain a surface upon which a patient may rest their feet when the exhaust reservoirs 16*a*, 16*b*, 16*c* are not full of fluid. The foam pad 26 may also help support the region of the exhaust reservoirs 16*a*, 16*b*, 16*c* even when the exhaust reservoirs 16*a*, 16*b*, 16*c* are full of fluid. While the foam pad 26 is shown substantially cutaway in FIG. 1, it should be understood that the foam pad 26 may surround the entirety of the exhaust reservoirs 16, the manifold 14, and provide support directly below the topper pad 30 proximate the foot end 24. Like the exhaust reservoirs 16, the foam pad 26 may be located proximate the foot end 24 of the cushioning device 10 between the plurality of fluid cells 12 and the foot end 24.

It should be understood that in other embodiments, the exhaust reservoirs 16*a*, 16*b*, 16*c* may not be located at the foot end 24 at all and may be located in virtually any appropriate location of the cushioning device 10. In other embodiments, the exhaust reservoirs 16*a*, 16*b*, 16*c* may be stored at the head end 22 instead. Alternately, they may be located on a left or right side of the cushioning device 10. In one embodiment, the exhaust reservoirs 16*a*, 16*b*, 16*c* may even be stored underneath the other fluid cells 12 of the cushioning device 10. The exhaust reservoirs 16*a*, 16*b*, 16*c* may also be stored in multiple locations, such as both the head end 22 and the foot end 24.

The foam pad 26 and exhaust reservoirs 16*a*, 16*b*, 16*c* may have length of sixteen inches along the axis extending between the head end 22 and the foot end 24, in one embodiment, while the fluid cells 12 may have a length of about fifty inches. The foam pad 26 and fluid cells 12 may have a longer or shorter length in other embodiments depending on the necessary size of the exhaust reservoirs 16*a*, 16*b*, 16*c*, for example. The exhaust reservoirs may have a full volume that is between 5 and 15 percent of the total volume that is retainable within the plurality of fluid cells 12. Thus, the size of the exhaust reservoirs 16*a*, 16*b*, 16*c* may change depending on various factors such as the weight of the patient and the intended pressures. Furthermore, the exhaust reservoirs 16*a*, 16*b*, 16*c* are shown to have equivalent volumes. However, in other embodiments, one or all of the exhaust reservoirs 16*a*, 16*b*, 16*c* may have different volumes than each other.

The cushioning device 10 further includes an outer envelope 28 and a topper cushion 30. The outer envelope 28 may surround the entire cushioning device 10 including the plurality of fluid cells 12, the manifold system 14, the exhaust reservoirs 16 and the foam pad, and the outer envelope 28 may help to retain the fluid cells 12, manifold system 14, foam pad 26 and the exhaust reservoirs 16 in a proper position. The outer envelope 28 may be made of a material such as a polymer, cloth, rubber, or the like. The topper cushion 30 may rest on top of the outer envelope 28 and may provide further cushioning to a resting patient. Depending on the embodiment, the topper cushion 30 may or may not be necessary. The topper cushion 30 may be composed of any resilient material, for example, foam, down feathers, an inflatable air cushion, etc.

Figure 3:
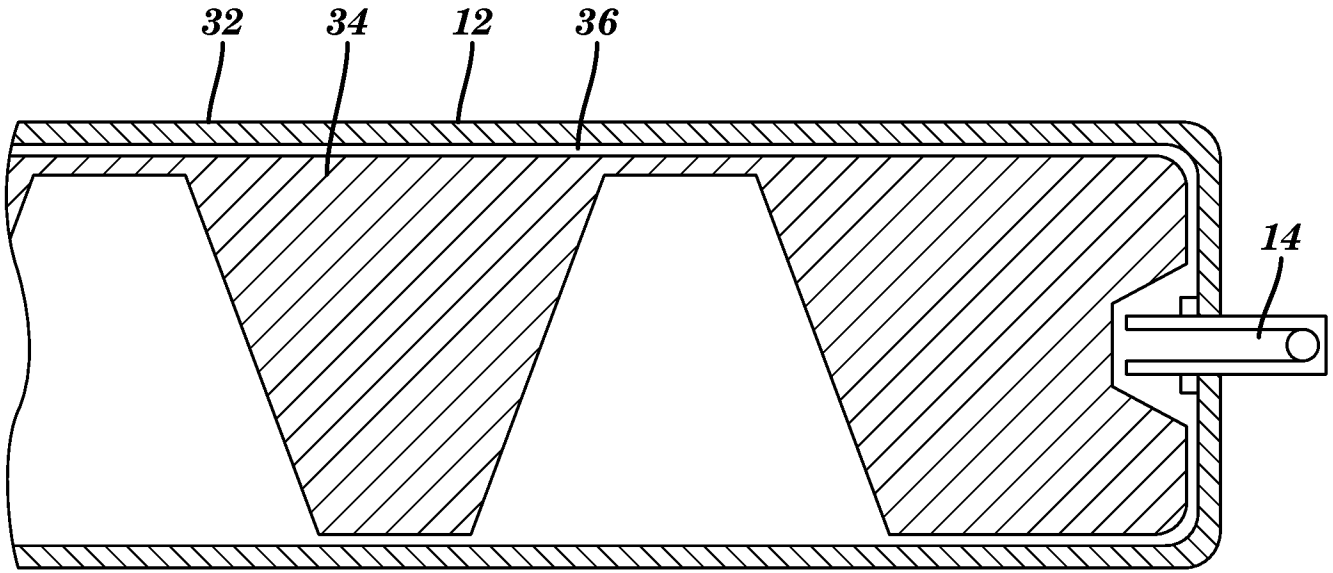
FIG. 3 depicts a partial cross-sectional view of a fluid cell of the cushioning device of FIGS. 1-2 including a reforming element and connected to a manifold.

FIG. 3 shows a partial cross sectional view of an example fluid cell, such as one of the fluid cells 12*a*, 12*b*, 12*c*, 12*d*. The support cells 12 may each include an outer envelope 32 that may contain a fluid and a reforming element 34. The application of an external load on the envelope 32, described hereinbelow, causes the envelope 32 to deform into a compressed form, adding internal pressure to the system. The reforming element 34 provides a reforming force to the interior surface 36 of the envelope 32. The reforming force causes the envelope 32 to return to its original form when the external load is removed from the envelope 32. The reforming element 34 may be a resilient foam material. However, other resilient means may be used such as a coil spring or bellows (not shown). The coil spring may be surrounded by a resilient material also. The bellows may be formed from a pliable resilient material such as plastic and filled with a fluid such as air.

The manifold system 14 may connect the plurality of fluid cells 12. The manifold system 14 may, in one embodiment, include tubing or piping. The tubing or piping includes apertures for connecting to each of the plurality of fluid cells 12. The manifold system 14 may or may not include valves at each connection location, such as a check valve or a pressure relief valve (not shown), of the plurality of fluid cells 12. In one embodiment, no valves are used. In an unvalved embodiment, the manifold system 14 freely distributes fluid between the plurality of cells 12 such that pressure is equally distributed in each of the plurality of cells 12 upon the receiving of a load on the cushioning device 10. The manifold system 14 may thus be configured to distribute air or other fluid between each of the plurality of fluid 12 cells to maintain an equilibrium pressure in the plurality of fluid cells 12. The manifold system 14 may not include a check valve exposed to the atmosphere in one embodiment. This may allow the cushioning device 10 to remain closed with no exposure to the atmosphere while in use.

However, somewhere in the cushioning device 10 there may be disposed a manual open and close valve 38. The manual open and close valve 38 is shown connected to the rightmost fluid cell 12*d*. The manual open and close valve 38 may be a valve that is configured to open when a particular needle is inserted therein for air intake into the plurality of fluid cells 12. Thus, although the cushioning device 10 may operate under the conditions of a closed system with no exposure to the atmosphere in use, the manual open and close valve 38 may be utilized to initially fill the system with fluid. The cushioning device 10 may be filled through the manual open and close valve 38 in the factory, or in the hospital. The manual open and close valve 38 may be an integrated feature of the manifold system 14. In other embodiments, the manual open and close valve 38 may be directly connected to one of the plurality of fluid cells 12. The manual open and close valve 38 may be connected to any location in the cushioning system 10 that allows fluid or air to be introduced in the system. The manual open and close valve 38 may further include a HEPA filter in order to ensure that the fluid being introduced into the plurality of fluid cells 12 is not contaminated. Furthermore, the manual open and close valve 38 may be used in case periodic refilling of the cushioning device 10 is necessary due to slight leakage of fluid in the system.

Figure 4:
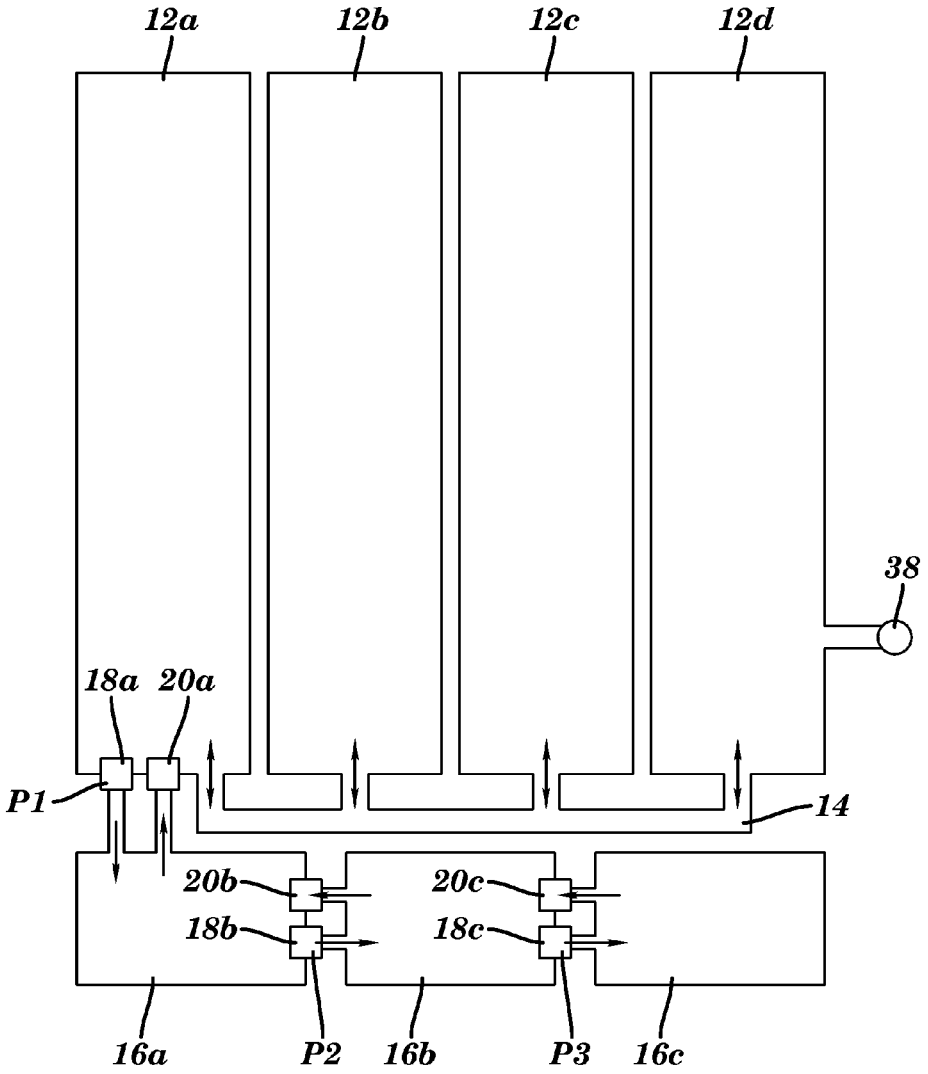
FIG. 4 depicts a schematic view of the cushioning device of FIGS. 1-2 according to one embodiment.

Referring now to FIG. 4, a schematic view of the cushioning device 10 is shown. It should be understood that this is an exemplary embodiment and is not meant to be limiting. As shown, the fluid cells 12 are interconnected by the manifold to create a system whereby each of the fluid cells 12*a*, 12*b*, 12*c*, 12*d* distribute fluid to retain an equilibrium pressure after receiving a load. The left-most fluid cell 12*a* is shown having the pressure relief valve 18*a* and a check valve 20*a* that is connected to the first exhaust reservoir 16*a*. The pressure relief valve 18*a* shows an arrow denoting air flow in the direction of the first exhaust reservoir 16*a*. The pressure relief valve 18*a* is marked by P1, denoting that the pressure relief valve is configured to let air flow in the direction of the first exhaust reservoir 16*a* when the pressure in the left most fluid cell 12*a* exceeds the pressure P1. The check valve 20*a* shows an arrow denoting air flow in the direction of the left most fluid cell 12*a*. Located to the right of the first exhaust reservoir 16*a* is the second exhaust reservoir 16*b*. The first exhaust reservoir 16*a* is shown having the pressure relief valve 18*b* and a check valve 20*b* that is connected to the second exhaust reservoir 16*b*. The pressure relief valve 18*b* shows an arrow denoting air flow in the direction of the second exhaust reservoir 16*b*. The pressure relief valve 18*b* is marked by P2, denoting that the pressure relief valve 18*b* is configured to let air flow in the direction of the second exhaust reservoir 16*b* when the pressure in the first exhaust reservoir 16*a* exceeds the pressure P2. The check valve 20*b* shows an arrow denoting air flow in the direction of the first exhaust reservoir 16*a*.

Located to the right of the second exhaust reservoir 16*b* is the third exhaust reservoir 16*c*. The first exhaust reservoir 16*a* is shown having the pressure relief valve 18*c* and a check valve 20*c* that is connected to the third exhaust reservoir 16*c*. The pressure relief valve 18*c* shows an arrow denoting air flow in the direction of the third exhaust reservoir 16*c*. The pressure relief valve 18*c* is marked by P3, denoting that the pressure relief valve 18*c* is configured to let air flow in the direction of the third exhaust reservoir 16*c* when the pressure in the second exhaust reservoir 16*b* exceeds the pressure P3. As described in the key at the bottom of FIG. 4, in the embodiment depicted P1<P2<P3. However, this embodiment is not limiting. The check valve 20*c* shows an arrow denoting air flow in the direction of the second exhaust reservoir 16*b*.

Figure 6:
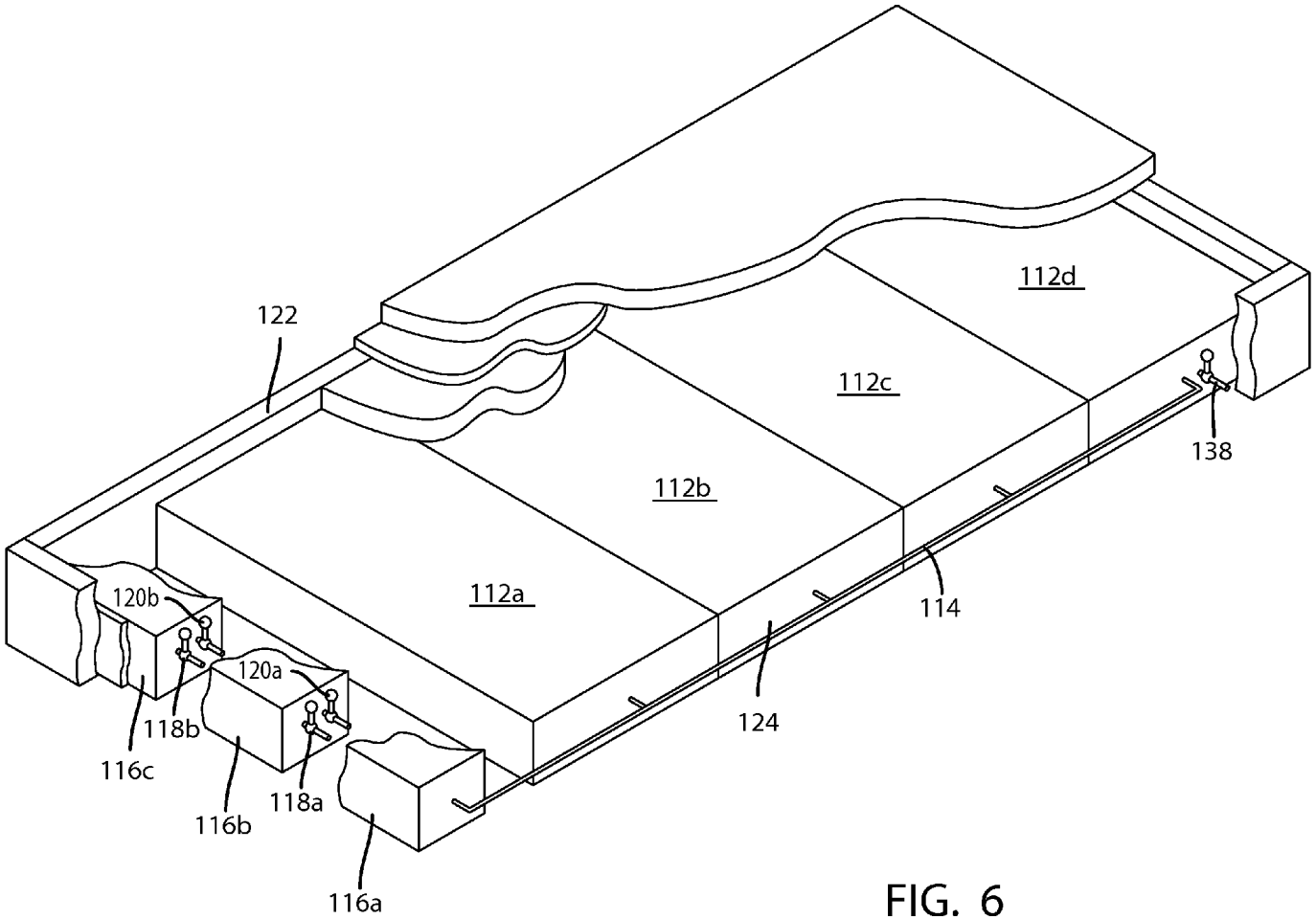
FIG. 6 depicts a perspective cutaway view of another cushioning device according to one embodiment.

Thus, the exhaust reservoirs 16*a*-16*c* may be connected in series. In other words, fluid may to and from the plurality of fluid cells 12 to the first exhaust reservoir 16*a*, and from the first exhaust reservoir 16*a* to and from the second exhaust reservoir 16*b*, and from the second exhaust reservoir 16*b* to and from the third exhaust reservoir 16*c*. Thus, the first exhaust reservoir 16*a* is not connected directly to the third exhaust reservoir 16*c*. This series connection may allow for the pressure relief valves 18 to open more and more volume for pressure relief in the plurality of fluid cells 12 through the exhaust reservoirs 16 as necessary. As shown in FIGS. 1, 4, and 6, similar to a series electrical circuit, this series connection of the exhaust reservoirs 16*a*-16*c* requires that fluid travel through the exhaust reservoir 16*b* when traveling between exhaust reservoirs 16*a* and 16*c*. In other words, fluid traveling in series through the exhaust reservoirs 16*a*-16*c* cannot be diverted from a path that passes through each one of the successive exhaust reservoirs.

Figure 5:
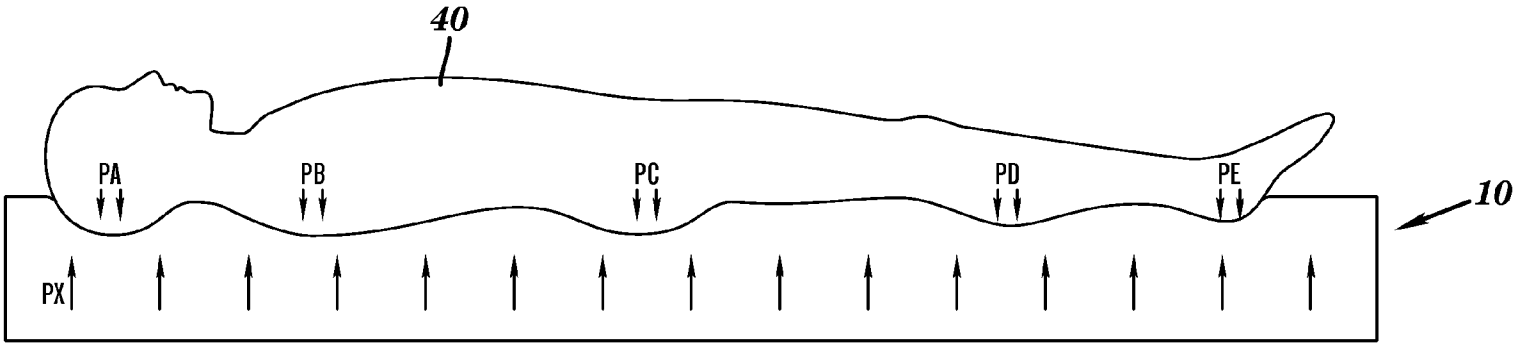
FIG. 5 depicts a representation of a body resting on a cushioning device of FIGS. 1-2 and 4 according to one embodiment.

In use, a body or a patient 40 rests on the cushioning device 10, as shown in FIG. 5. The body 40 exhibits a pressure on the fluid within each of the plurality of fluid cells 12. The pressure of the fluid within each of the plurality of fluid cells 12 increases as the volume of the plurality of fluid cells 12 decreases. The body 40 may exhibit more pressure on, for example, the middle fluid cells 12*b*, 12*c*. However, the manifold system 14 may be configured to distribute fluid from the middle fluid cells 12*b*, 12*c* to the outer fluid cells 12*a*, 12*d*. Thus, the system eventually is capable of achieving an equilibrium pressure through the manifold system 14. As shown, high pressure regions on the body 40 are indicated by the force arrows PA, PB, PC, PD and PE. The cushioning device 10 provides a low uniform interface pressure PX that supports the entire contact surface of the body 40. This interface pressure is below the pressure that may cause tissue damage, thereby preventing the formation of pressure sores and other injuries.

If the pressure on the fluid within the fluid cell 12*a* reaches first pressure P1, the pressure relief valve 18*a* opens to release fluid into the first exhaust reservoir 16*a*, effectively lowering the pressure of the fluid in the connected fluid cells 12*a*-12*d*. The fluid continues to be released into the first exhaust reservoir 16*a* until the pressure in the first exhaust reservoir 16*a* reaches a second pressure P2. At this time, the second pressure relief valve 18*b* in the first exhaust reservoir 16*a* opens to release fluid into the second exhaust reservoir 16*b*. The fluid continues to be released into the second exhaust reservoir 16*b* until the pressure in the second exhaust reservoir 16*b* reaches a second pressure P3. At this time, the third pressure relief valve 18*c* in the second exhaust reservoir 16*b* opens to release fluid into the third exhaust reservoir 16*c*. Eventually the system thereby achieves an equilibrium pressure after receiving the body 40. It should be understood that the fluid in the system may be flowing through multiple pressure relief valves 18 at the same time, and through the manifold system 14, rather than flow in the linear manner described hereinabove.

As the weight of the body 40 or patient is removed from the cushioning device 10, the reforming element 34 in each of the plurality of fluid cells 12 exerts a reforming force on the interior surface 36 of the plurality of fluid cells 12. As each fluid cell 12 expands, a partial vacuum is created in the interior of the fluid cells 12. The vacuum draws fluid from the exhaust reservoirs 16*a*-16*c* through the check valves 20*a*-20*c*. Thus, the cushioning device 10 has the ability to be a dynamic system that is always adjusting to movements or repositioning by the body 40. When the pressure distribution applied to cushioning device 10 changes, the plurality of fluid cells 12 may automatically inflate or deflate to ensure a low interface pressure under the entire body 40 or patient.

Referring back to FIG. 1, the plurality of fluid cells 12 of the cushioning device 10 may include reforming elements 34 of varying densities. For example, in the embodiment shown in FIG. 1, a portion 45 of the surface area of the fluid cells 12 may be supported by a higher density reforming element than the remaining surface area of the fluid cells 12. In one embodiment, the reforming elements found 34 in the plurality of fluid cells 12 may be different density foams. The fluid cells 12 may include portions along the length having greater density foam that is stiffer and more resilient, for example within the portion 45. Outside the portion 45, the fluid cells 12 may include lesser density foam that is less resilient and softer. In some embodiments, the individual cells 12 may each have their own density. In those embodiments, the cells may be aligned horizontally (90 degrees from the orientation shown) and certain cells along the length of the bed may have greater densities than other cells.

Referring still to FIG. 1 in combination with FIG. 5, it should be understood that the greater density areas of the present invention are not limited to the area shown and that any area on the surface of the cushioning device may be supported by greater or lesser density reforming foam. In the embodiment shown, the portion 45 supporting the posterior of a patient, shown by pressure PC in FIG. 5, includes the greater stiffness reforming element. In some embodiments, there may be other locations that include greater stiffness reforming elements, such as the area support the head of the patient (shown by pressure PA), the back of the patient (shown by pressure PB), the calf of the patient (shown by pressure (PD), and the heel of a patient (shown by pressure PE). The density difference in foam may be 25% greater than the density of the foam in the softer areas. For example, the density difference may be between 5% and 50% denser in the dense portion 45 compared to the softer remaining portion of the fluid cells 12.

Referring now to FIG. 6, another embodiment of a cushioning device 100 is shown. The cushioning device 100 may be similar to the cushioning device 10 and may include a plurality of fluid cells 112*a*, 112*b*, 112*c*, 112*d* that are similar to the plurality of fluid cells 12*a*, 12*b*, 12*c*, 12*d*. The cushioning device 100 may further include a manual open and close valve 138, similar to the manual open and close valve 38, but moved in position to another side of the cushioning device 100. However, rather than running lengthwise from head end to foot end, the plurality of fluid cells 112*a*, 112*b*, 112*c*, 112*d* may run horizontally from a left side 122 to a right side 124 of the cushioning device 100. It should be understand that more or less than four fluid cells may be used in other embodiments, by lengthening or shortening the dimensions of each cell to ensure the providing of a mattress having the desired surface area.

Furthermore, a manifold system 114 is shown running along the right side 124 of the cushioning device 100, rather than at the foot end as in the previous embodiment described hereinabove. In this embodiment, the manifold system 114 is directly connected to a first exhaust reservoir 116*a* that is located at the right side of the foot end. Thus, there may not be a pressure relief valve or a check valve located between the plurality of fluid cells 112 and the first exhaust reservoir 116*a* in this embodiment. It should be understood that the previous embodiment having lengthwise fluid cells 12 may also be configured such that no valves are located between the first fluid cell 12*a* and the first exhaust reservoir 16*a*.

This first exhaust reservoir 116*a* of the cushioning device 100 may be attached to a second exhaust reservoir 116*b*. A first pressure relief valve 118*a* and a first check valve 120*a* may be located between the first exhaust reservoir 116*a* and the second exhaust reservoir 116*b*. Likewise, the second exhaust reservoir 116*b* may be attached to the third exhaust reservoir 116*c*. A second pressure relief valve 118*b* and a second check valve 120*b* may be located between the second exhaust reservoir 116*b* and the third exhaust reservoir 116*c*. The pressure relief valves 118*a*, 118*b* may be similar to the pressure relief valves 18*a*, 18*b*, 18*c*, and the check valves 120*a*, 120*b* may be similar to the check valves 20*a*, 20*b*, 20*c*. Further, the first pressure relief valve 118*a* may be set to a lower pressure to release fluid into the second exhaust reservoir 116*b* than the second pressure relief valve 118*b* is set to release fluid into the third exhaust reservoir. Thus, when a patient applies weight to the plurality of fluid cells 112, fluid automatically distributes throughout the four fluid cells 112 and the first exhaust reservoir 116*a* until pressure is evenly distributed. Then if the pressure in the first exhaust reservoir 116 becomes greater than the first pressure relief valve 118*a* is set to retain, the first pressure relief valve 118*a* opens, allowing fluid into the second exhaust reservoir 116*b*. Likewise, if the pressure in the second exhaust reservoir 116 becomes greater than the second pressure relief valve 118*b* is set to retain, the second pressure relief valve 118*b* opens, allowing fluid into the third exhaust reservoir 116*c*.

It should be understood that any number of exhaust reservoirs 116 are contemplated. This embodiment shows that the first exhaust reservoir 116*a* may be directly connected to the manifold 114 instead of separated from the plurality of fluid cells 112 with additional valves like the previous embodiment. Furthermore, in this embodiment, the greater density portion on the surface of the cushioning device 100 may include the entire second fluid cell 112*b*, rather than a portion of multiple fluid cells as shown in the previous embodiment. In this embodiment, the second fluid cell 112*b* may be in the exact position on the cushioning device 100 to support a patient's posterior.

In another embodiment, a method of cushioning a body, such as the body 40 includes providing a cushioning device, such as the cushioning device 10. The cushioning device may include a plurality of fluid cells, such as the fluid cells 12, each containing a reforming element, such as the reforming element 34, and a fluid for supporting a load. The cushioning device may further include a manifold system, such as the manifold system 14, interconnecting the plurality of fluid cells, and an exhaust system including a first exhaust reservoir, such as the first exhaust reservoir 16*a*, and a second exhaust reservoir, such as the second exhaust reservoir 16*b*, connected in series to the plurality of envelopes. The method may further include exhausting fluid from the plurality of fluid cells to the first exhaust reservoir when pressure in the plurality of fluid cells reaches a first predetermined pressure. The method may further include exhausting fluid from the first exhaust reservoir to the second exhaust reservoir when pressure in the first exhaust reservoir reaches a second predetermined pressure. The method may also include returning fluid from the first exhaust reservoir and the second exhaust reservoir to the plurality of fluid cells when a load is removed from the plurality of fluid cells.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

I claim:

1. A cushioning device comprising:

a plurality of fluid cells each containing a reforming element and a fluid for supporting a load;

a manifold system interconnecting the plurality of fluid cells;

an exhaust system including a first and a second exhaust reservoir connected in series to each other, the exhaust system configured to receive exhausted air from the plurality of fluid cells when the plurality of fluid cells are subjected to the load; and wherein the first and second exhaust reservoirs are connected with a pressure relief valve allowing fluid to escape from the first exhaust reservoir to the second exhaust reservoir when the pressure in the first exhaust reservoir exceeds a threshold and a check valve allowing fluid to flow back from the second exhaust reservoir to the first exhaust reservoir.

2. The cushioning device of claim 1, wherein the exhaust system further includes a third exhaust reservoir connected to the second exhaust reservoir in series and separated by the second exhaust reservoir by a second check valve and a second pressure relief valve, wherein when the pressure from the first exhaust reservoir reaches a first predetermined level, the pressure relief valve opens and exhausts fluid into the second exhaust reservoir, and wherein when the pressure from the second exhaust reservoir reaches a second predetermined level, the second pressure relief valve opens and exhausts fluid into the third exhaust reservoir.

3. The cushioning device of claim 1, further comprising: an outer envelope surrounding the plurality of fluid cells, the manifold system and the exhaust system.

4. The cushioning device of claim 1, wherein the cushioning device is a mattress.

5. The cushioning device of claim 4, wherein the plurality of fluid cells each extend between a head end to a foot end of the mattress, and wherein the first and second exhaust reservoirs are located proximate the foot end of the mattress between the plurality of fluid cells and the foot end.

6. The cushioning device of claim 1, wherein the first and second exhaust reservoirs have a volume that is between 5-15 percent of the volume of the plurality of fluid cells.

7. The cushioning device of claim 1, further including a manual open and close valve connected to at least one of the manifold system and the plurality of fluid cells, the manual open and close valve including a HEPA filter.

8. The cushioning device of claim 1, wherein the cushioning device operates in a closed system with no exposure to atmospheric air in use.

9. The cushioning device of claim 2, wherein the first predetermined level is less than the second predetermined level.

10. The cushioning device of claim 1, wherein the manifold system does not include a check valve exposed to the atmosphere, wherein the manifold system is configured to distribute fluid between each of the plurality of fluid cells to maintain an equilibrium pressure in the plurality of fluid cells.

11. The cushioning device of claim 1, wherein a surface of the cushioning device includes an area that is supported by at least one reforming element that has a greater density than another reforming element.

12. The cushioning device of claim 1, wherein the first and second exhaust reservoirs have a combined volume relative to the plurality of fluid cells such that fluid always remains between the entirety of area contacted by the load and a bottom surface of the cushioning device.

13. A cushioning device comprising:

a plurality of fluid cells, each of the fluid cells including a reforming element;

a manifold system interconnecting the plurality of fluid cells;

a first exhaust reservoir connected in series to the plurality of fluid cells with a first pressure relief valve and a first check valve; and a second exhaust reservoir directly connected in series to the first exhaust reservoir with a second pressure relief valve and a second check valve;

wherein when the pressure in the plurality of fluid in the plurality of fluid cells reaches a first predetermined level, the first pressure relief valve opens and exhausts fluid into the first exhaust reservoir, and wherein when the pressure in the first exhaust reservoir reaches a second predetermined level, the second pressure relief valve opens and exhausts fluid into the second exhaust reservoir and wherein the first check valve allows fluid to return to the plurality of fluid cells and wherein the second check valve allows fluid to return from the second exhaust reservoir to the first exhaust reservoir.

14. The cushioning device of claim 13, further comprising:

a third exhaust reservoir connected to the second exhaust reservoir with a third pressure relief valve and a third check valve, wherein when the pressure from the second exhaust reservoir reaches a third predetermined level, the third pressure relief valve opens and exhausts fluid into the third exhaust reservoir.

15. The cushioning device of claim 13, further comprising: an outer envelope surrounding the plurality of fluid cells, the manifold system and the first and second exhaust reservoirs.

16. The cushioning device of claim 13, wherein the cushioning device is a mattress.

17. The cushioning device of claim 16, wherein the plurality of fluid cells each extend between a head end to a foot end of the mattress, and wherein the first and second exhaust reservoirs are located proximate the foot end of the mattress between the plurality of fluid cells and the foot end.

18. The cushioning device of claim 17, wherein the first and second exhaust reservoirs are encased by foam.

19. The cushioning device of claim 13, further including a manual open and close valve connected to at least one of the manifold system and the plurality of fluid cells, the manual open and close valve including a HEPA filter.

20. The cushioning device of claim 13, wherein the cushioning device operates in a closed system with no exposure to atmospheric air in use.

21. The cushioning device of claim 13, wherein the first predetermined level is less than the second predetermined level.

22. The cushioning device of claim 13, wherein the manifold system does not include a check valve exposed to the atmosphere, wherein the manifold system is configured to distribute fluid between each of the plurality of fluid cells to maintain an equilibrium pressure in the plurality of fluid cells.

23. The cushioning device of claim 13, wherein a surface of the cushioning device includes an area that is supported by at least one reforming element that has a greater density than another reforming element.

24. The cushioning device of claim 13, wherein the first and second exhaust reservoirs have a combined volume relative to the plurality of fluid cells such that fluid always remains between the entirety of area contacted by the load and a bottom surface of the cushioning device.

25. A method of cushioning a body comprising:

providing a cushion including a plurality of fluid cells each containing a reforming element and a fluid for supporting a load, a manifold system interconnecting the plurality of fluid cells and an exhaust system including a first exhaust reservoir and a second exhaust reservoir connected in series to each other;

automatically exhausting fluid from the plurality of fluid cells to the first exhaust reservoir when a load is applied on the plurality of fluid cells;

automatically exhausting fluid from the first exhaust reservoir to the second exhaust reservoir when pressure in the first exhaust reservoir reaches a predetermined pressure with a pressure relief valve that directly connects the first exhaust reservoir and the second exhaust reservoir; and automatically returning fluid from the second exhaust reservoir to the first exhaust reservoir when a load is removed from the plurality of fluid cells with a check valve that directly connects the first exhaust reservoir and the second exhaust reservoir.

* * * * *